US006038791A

United States Patent [19]

Cornelius et al.

[11] Patent Number: 6,038,791

[45] **Date of Patent: *Mar. 21, 2000**

[54] BUCKLING APPARATUS USING ELONGATED SKATE CUFF

[75] Inventors: Dirk L. Cornelius, Oakdale; Gregor Mittersinker, Minneapolis, both of Minn.

[73] Assignee: Rollerblade, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,759

[22] Filed: Dec. 22, 1997

[51] Int. Cl.[7] ..... A43C 11/14; A43B 5/04

[52] U.S. Cl. ..... 36/115; 36/50.1; 36/50.5; 36/117.1

[58] Field of Search ..... 36/50.1, 50.5, 36/115, 117.1, 118.2, 117.2

[56] References Cited

U.S. PATENT DOCUMENTS

| | | | |
|---|---|---|---|
| 3,483,638 | 12/1969 | Baso | 36/115 |
| 3,494,054 | 2/1970 | Lange | 36/115 |
| 3,561,139 | 2/1971 | Stillman | 36/115 |
| 3,597,862 | 8/1971 | Vogel . | |
| 3,849,914 | 11/1974 | Bertele | 36/115 |
| 4,143,474 | 3/1979 | Blanc | 36/117.1 |
| 4,245,410 | 1/1981 | Molitor | 36/117.1 |
| 5,226,246 | 7/1993 | Soo | 36/50.5 |
| 5,279,052 | 1/1994 | Perotto et al. . | |
| 5,331,752 | 7/1994 | Johnson et al. | 36/115 |
| 5,410,822 | 5/1995 | Vaccari | 36/117 |
| 5,548,909 | 8/1996 | Foffano et al. | 36/117.1 |
| 5,592,722 | 1/1997 | Foscaro et al. | 36/50.5 |
| 5,678,833 | 10/1997 | Olson et al. | 36/115 |

FOREIGN PATENT DOCUMENTS 1915442 10/1970 Germany .

*Primary Examiner*—Paul T. Sewell
*Assistant Examiner*—Anthony Stashick
*Attorney, Agent, or Firm*—Merchant & Gould P.C.

[57] ABSTRACT

A cuff buckling apparatus to ease the buckling of an in-line skate or other boot having a cuff is provided. The in-line skate includes a boot having front and back portions corresponding to the front and back of a skater's leg, and medial and lateral portions corresponding to the medial side and lateral side of the skater's leg respectively. A leg cuff encases the back, medial and lateral portions of the boot, and includes a cuff flap originating proximate the medial portion of the boot. The cuff flap has sufficient length to cross the front portion of the boot when folded over the front of the boot. A buckle lever is coupled to the leg cuff proximate the lateral portion of the boot, and a buckle strap is mounted to the buckle lever. A buckle strap latching mechanism attaches to the cuff flap, and engages the free end of the buckle strap. The leg cuff is tightened around the skater's leg upon actuating the buckle lever.

19 Claims, 5 Drawing Sheets

BUCKLING APPARATUS USING ELONGATED SKATE CUFF

FIELD OF THE INVENTION

The present invention relates generally to a buckling apparatus for use in activities such as in-line skating or the like. More particularly, this invention pertains to an improved cuff buckling apparatus to ease the buckling of an in-line skate or other boot having a cuff.

BACKGROUND OF THE INVENTION

In-line skating has become very popular in recent years. In-line skates use a tandem wheel arrangement which is mounted to a boot that typically encompasses both the foot and lower leg. This type of boot must be buckled onto the foot and leg in a manner which provides a good fit. However, it is also important that in-line skates be capable of being buckled as easily and quickly as possible.

One problem with existing buckling mechanisms is that two cuff flaps must be correctly aligned at or around the front of the leg in order to allow a buckle attached to one cuff flap to properly engage a buckle strap attached to the other cuff flap. This alignment is also necessary where the first cuff flap includes a buckle that is mounted to the buckle strap, and the buckle strap engages the opposite cuff flap via a strap receiver. If the cuff flaps overlap proximate the front of the skater's leg, the overlap must be positioned in a particular manner so that the buckle strap correctly engages the buckle or buckle strap receiver. If incorrectly positioned, the buckle may not properly engage, or the cuff may be uncomfortable to the skater. Therefore, it is important that cuff flaps be positioned correctly as they are overlapped.

In prior art devices, concurrently positioning the cuffs and engaging the buckling mechanism has proved to be difficult. For example, where a buckle lever is attached to a first cuff, the overlapping cuffs must be positioned, and held in place, while the buckle is actuated with the same hand. It is therefore desirable to avoid having to manipulate moving parts, such as a buckle lever, while properly positioning the cuff.

SUMMARY OF THE INVENTION

The present invention relates to an improved cuff buckling apparatus to ease the buckling of an in-line skate or other boot having a cuff.

In accordance with one embodiment of the invention, an in-line skate incorporating a cuff buckling apparatus is provided. A boot for the skate includes front and back portions corresponding to the front and back of a skater's leg, and further includes medial and lateral portions corresponding to the medial side and lateral side of the skater's leg respectively. A leg cuff, which encases the back, medial and lateral portions of the boot, includes a cuff flap which originates proximate the medial portion of the boot. The cuff flap has sufficient length to cross the front portion of the boot when folded across the front of the boot. The skate also includes a buckle lever coupled to the leg cuff proximate the lateral portion of the boot, and a buckle strap mounted to the buckle lever. A buckle strap latching mechanism attaches to the cuff flap, and engages the free end of the buckle strap. The leg cuff is tightened around the skater's leg when the buckle lever is actuated, because the cuff flap is pulled towards the lateral portion of the boot upon actuating the buckle lever. The location of the buckle strap latching mechanism therefore allows the buckle strap to be received at the cuff flap, so that the buckle lever itself can be placed elsewhere, thereby easing buckling of the in-line skate.

In accordance with another embodiment of the invention, a boot shell for use with a skate is provided. The boot shell includes a leg cuff having a back portion, a medial portion, and a lateral portion configured and arranged to respectively envelop a back leg portion, a medial leg portion, and a lateral leg portion of a skater's leg. The boot shell also includes a cuff flap originating at the medial portion of the leg cuff. The cuff flap is of sufficient length to reach the lateral portion of the leg cuff across the front, open portion of the boot shell. A buckle strap latching mechanism is attached to the cuff flap to receive and engage a buckle strap originating at the medial portion of the leg cuff.

In accordance with another embodiment of the invention, a shoe for use with a skate having a molded lower boot is provided. The shoe includes a soft leg cuff having a back portion, a medial portion, and a lateral portion configured and arranged to respectively envelop a back leg portion, a medial leg portion, and a lateral leg portion of a skater's leg. The soft leg cuff is coupled to the molded lower boot, and is flexible as compared to the molded lower boot. A soft leg cuff and skate is referred to as a "soft skate". A cuff flap is coupled to the medial portion of the soft leg cuff, and has a length sufficient to reach the lateral portion of the soft leg cuff. One end of a buckle strap is coupled to the soft leg cuff proximate the lateral portion of the leg cuff, and the other end of the buckle strap is a free end that can be used to engage a strap receiver. A buckle strap latching mechanism is attached to the cuff flap to receive and engage the free end of the buckle strap.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

DETAILED DESCRIPTION OF THE ILLUSTRATED EMBODIMENTS

Reference will now be made in detail to exemplary embodiments of the present invention which are illustrated in the accompanying drawings. Wherever possible, the same reference numbers will be used throughout the drawings to refer to the same or like parts.

Figure 1:
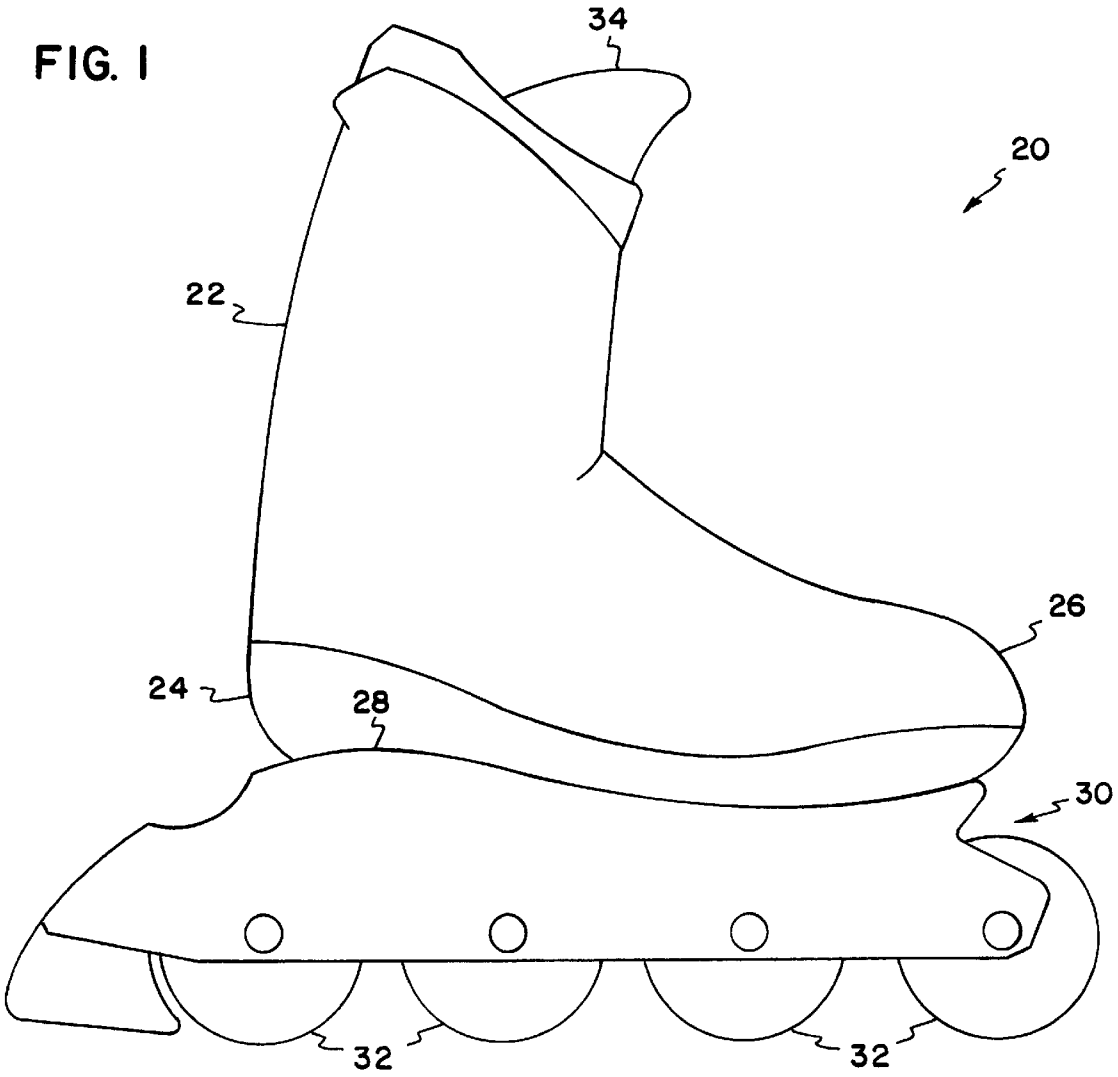
FIG. 1 shows a skate 20 to which the principles of the present invention can be applied.

FIG. 1 shows a skate 20 to which the principles of the present invention can be applied. The skate 20 includes a boot 22 having a heel portion 24, a toe portion 26 and a base 28. The skate 20 also includes a frame 30 adapted for rotatedly mounting a plurality of tandemly arranged wheels 32 along the base 28 of the boot 22. It will be appreciated that the skate 20 will be used in association with a mating skate having substantially the same construction.

The boot 22 of the skate 20 is preferably constructed of a semi-rigid material capable of providing support, especially ankle support, to a wearer of the skate 20. Exemplary materials having the requisite rigidity are plastics, leather, or composites thereof. As illustrated in FIG. 1, it is preferred for the boot 22 to be constructed of molded plastic so as to form a semi-rigid outer shell. A cushioned inner liner 34 is preferably inserted within the outer shell and functions to increase the comfort of the boot 22 and to provide additional foot support. The boot 22 is preferably tightly secured to a wearer's foot through the use of conventional fastening techniques such as laces, hooks, clasps or buckles.

The frame 30 of the skate 20 is preferably adapted for rotatedly mounting the plurality of wheels 32 along the base 28 of the boot 22. The frame 30 is preferably constructed of a rigid material such as steel and preferably is fastened to the base 28 of the boot 22 by rivets or bolts. Of course, the frame 30 can be constructed of a variety of materials and can be connected to the boot 22 by a variety of other conventionally known fastening techniques.

It will be appreciated that the principles of the present invention may be incorporated within a variety of different skates such as conventional roller skates or even ice skates. In the case of ice skates, the frame of the skate would comprise a conventional ice skate blade.

Figure 2:
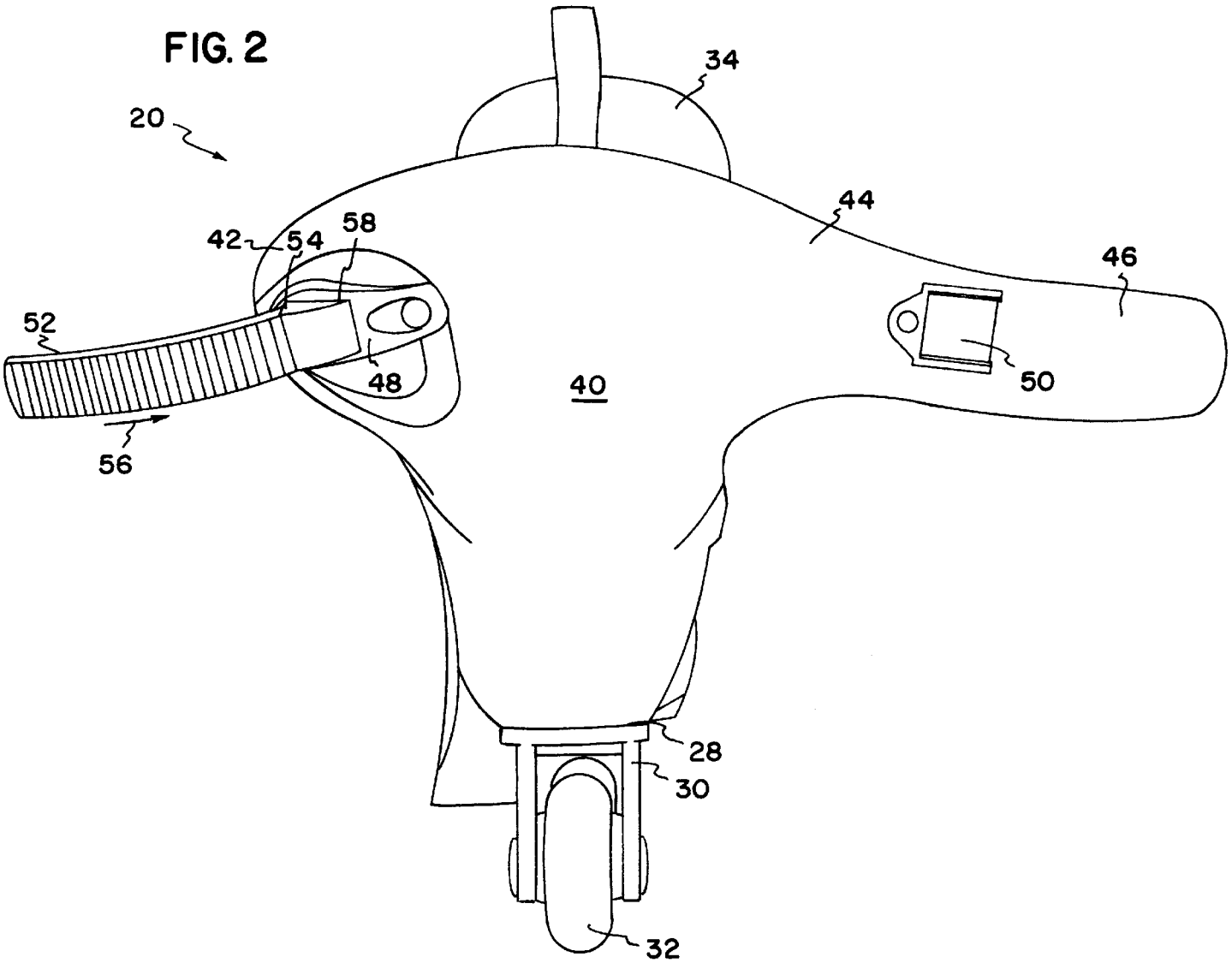
FIG. 2 is a rear view of an in-line skate including a cuff in accordance with the present invention.

FIG. 2 is a rear view of the in-line skate 20 wherein the boot includes a cuff 40 in accordance with the present invention. The cuff 40 envelops the inner liner 34, and in the present embodiment extends down to the base 28, which in turn is attached to the frame 30 that supports the wheels 32.

The cuff may be integral to the boot as illustrated in FIG. 2, or alternatively may include an independent piece affixed to the boot. The cuff may be used in any type of boot such as "hard" boots, which include a plastic shell, and "soft" boots such as the Synergy™ line of skates commercially available from the assignee of the present invention. These soft boots include a Cross-Molded Technology™, which refers to a unique construction of the skates which blends a soft upper cuff with a molded lower boot to provide comfort where it's wanted, and support where it's needed.

The example of FIG. 2 illustrates a skate which is worn on the left leg of the skater. In this case, the left, or outer portion 42 of the cuff 40 overlays the outer, or lateral, side of the skater's left leg. The right, or inner portion 44 of the cuff 40 overlays the inner, or medial, side of the skater's left leg. A boot fitting a right leg would have the cuff portions reversed accordingly.

The cuff 40, when positioned in its naturally molded form, extends from the outer side of the skater's leg proximate the outer portion 42 of the cuff 40, around the back of the boot, to the inner side of the skater's leg proximate the inner portion 44 of the cuff 40. The cuff 40 of the present invention also includes an elongated cuff flap 46 which is preferably an integral extension of the inner portion 44 of the cuff 40. The cuff flap 46 could alternatively be affixed to the inner portion 44 of the cuff 40. As will become more evident in the following description, the cuff flap 46 can be wrapped around the front side of the boot to be buckled to the outer portion 42 of the cuff 40, in order to snugly encase the skater's leg within the cuff 40.

In order to tighten the cuff 40, a buckling apparatus is used. In prior art buckling mechanisms, buckle levers were attached to one of a pair of cuff flaps which typically overlapped at the front of the boot. Overlapping the cuff flaps while attempting to engage the buckle lever proved to be difficult.

The present invention positions a buckle lever 48 at a substantially immobile location, which is the outer portion 42 of the cuff 40. The outer portion 42 of the cuff 40 does not extend substantially beyond the lateral side of the boot, and therefore is not as mobile as the extended cuff flap 46 is. Further, the cuff flap 46 of FIG. 2 includes a locking buckle strap receiver 50, which does not require significant manual manipulations during the buckling process. A buckle strap, such as buckle strap 52, can easily be inserted into the strap receiver 50 with little effort. Therefore, with one hand, the skater can guide the cuff flap 46 across the front of the boot to its appropriate position, while concurrently inserting the buckle strap 52 into the strap receiver 50 with the other available hand. By locating the strap receiver 50 on the elongated cuff flap 46, it is not necessary to hold two overlappable cuff flaps in place while attempting to actuate a buckle lever, as was required in the prior art.

In one embodiment of the invention, the buckle lever 48 is a lever, pivotable at connection point 54, which pulls the buckle strap 52 in the direction of arrow 56 when the buckle lever 48 is actuated. The buckle strap 52 is connected to the buckle lever 48 at connection point 58, which pulls the buckle strap 52 in the direction of arrow 56 when the buckle lever 48 is actuated by moving the connection point 58 in the same direction. The buckle lever 48 snaps in place against the cuff 40 upon full actuation.

The buckle strap 52 is a toothed strap in one embodiment of the invention. As seen in FIG. 2, the buckle strap 52 includes multiple grooves or "teeth" that engage interlocking grooves in the strap receiver 50, thereby removably attaching the buckle strap 52 to the strap receiver 50.

Figure 3:
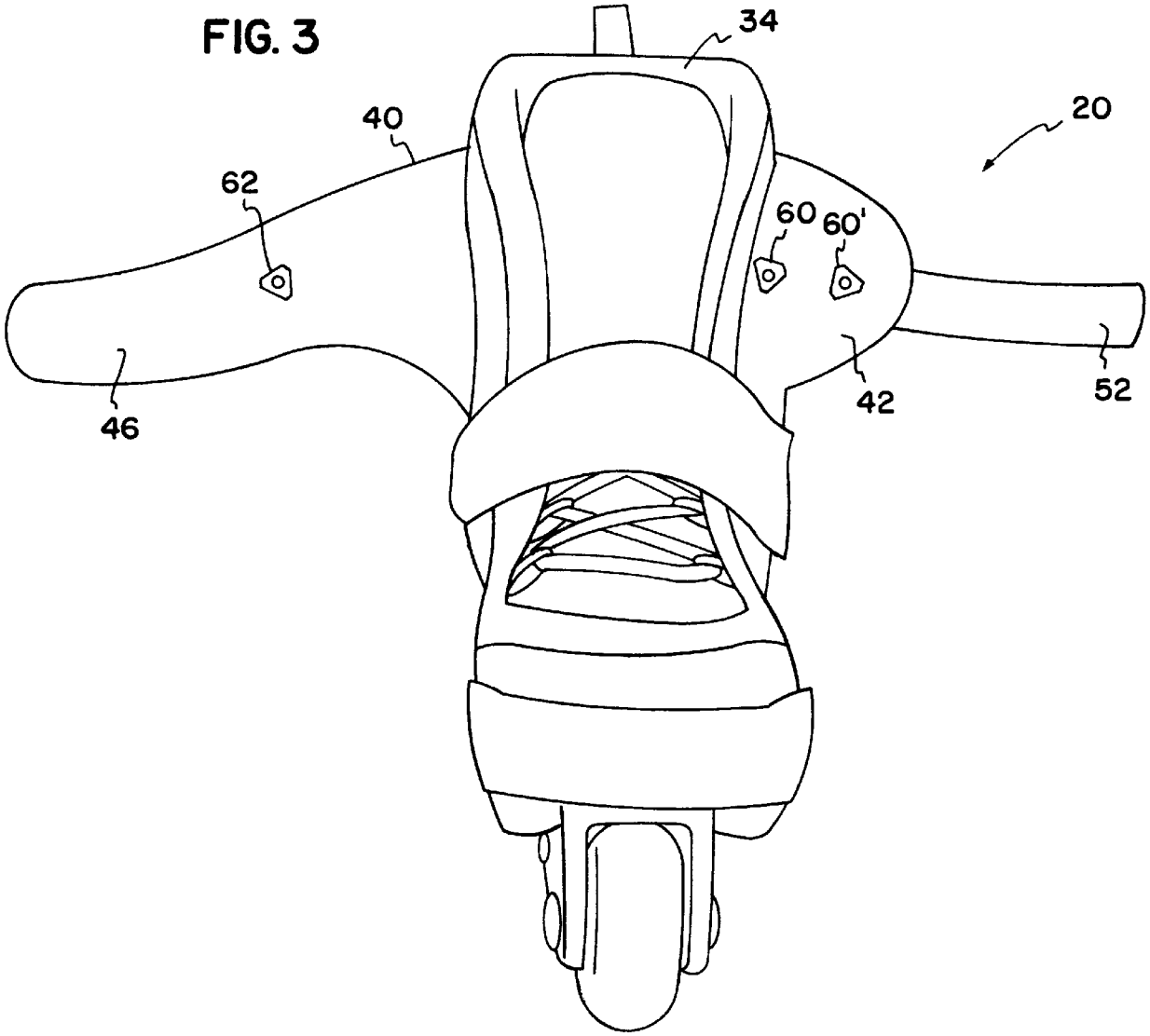
FIG. 3 is a front view of an in-line skate equipped with a cuff in accordance with the present invention.

FIG. 3 is a front view of the in-line skate 20 equipped with the cuff 40 in accordance with the present invention. As can be seen, the cuff 40 is positioned around the back of the boot which typically includes the inner liner 34. The portion of the cuff 40 shown is the interior portion of the cuff 40 which, when buckled, folds against the inner liner 34. The buckle lever 48 and the strap receiver 50 are therefore positioned on the opposite side of the cuff 40 portion shown in FIG. 3. The buckle lever 48 to which the buckle strap 52 is connected may be attached to the cuff 40 by bolts, rivets, or the like, as depicted by rivets 60 and 60'. The strap receiver 50 can be attached to the cuff flap 46 in a similar manner, as shown by rivet 62.

Figure 4:
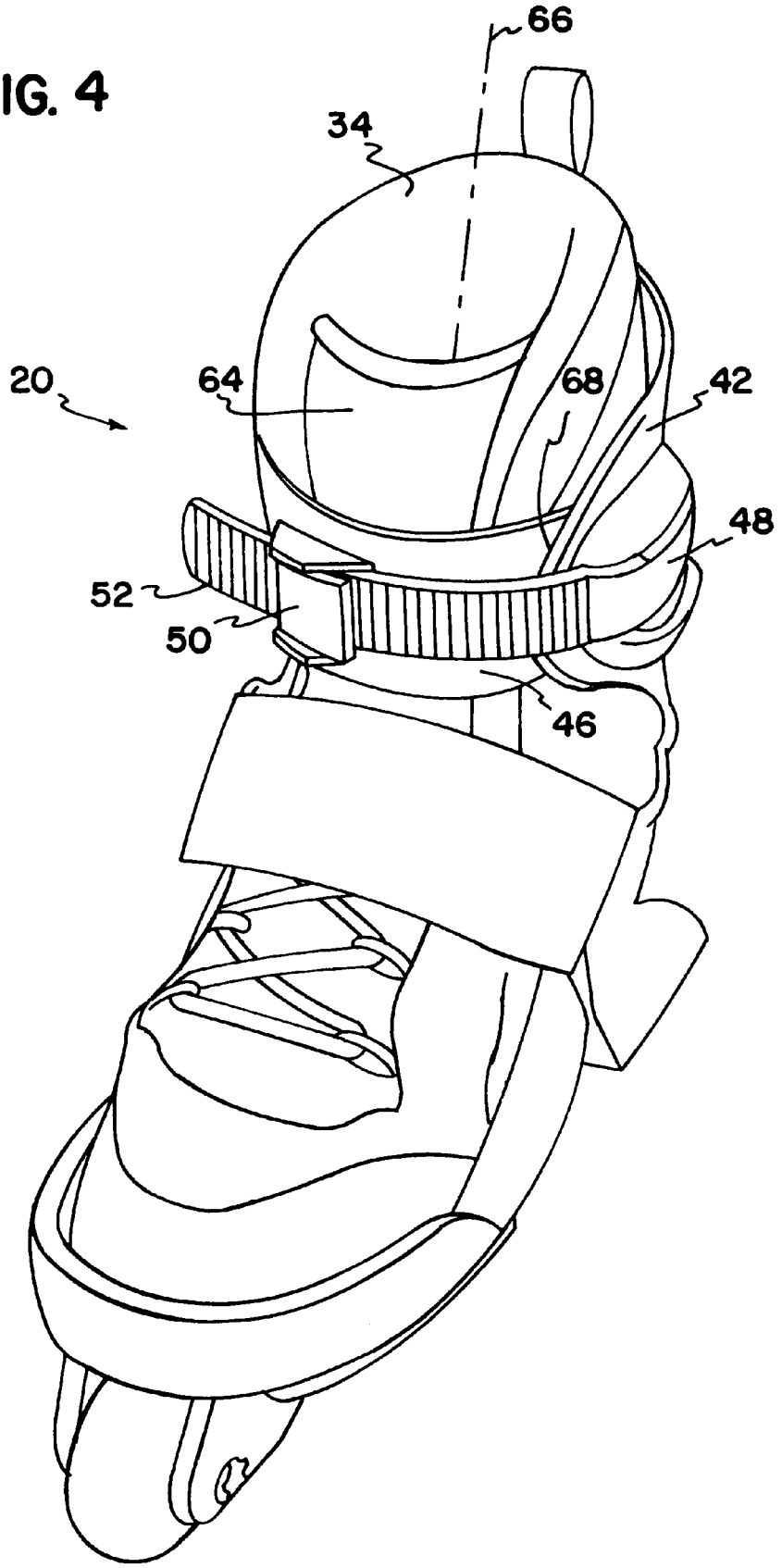
FIG. 4 illustrates a skate equipped with the cuff of the present invention in the buckled position.

FIG. 4 illustrates a skate 20 equipped with the cuff 40 of the present invention in the buckled position. The inner liner 34, and the tongue 64 of the boot conform about the leg (not shown) of the skater when the cuff 40 is buckled in the manner depicted in FIG. 4. The cuff flap 46 is wrapped across the front of the boot to the outer portion 42 of the cuff 40. The free end of the buckle strap 52 is inserted into the strap receiver 50. The strap receiver 50 provides a spring-loaded edge which engages a desired one of the grooves of the buckle strap 52 in a ratcheting manner. The buckle lever 48 is then actuated, which causes the buckle strap 52, and the affixed cuff flap 46, to move along the front of the boot towards the outer portion 42 of the cuff 40.

Because the outer portion 42 of the cuff 40 does not extend far beyond the lateral side of the boot, it remains substantially stationary. The free end of the cuff flap 46, on the other hand, can be moved radially with respect to a longitudinal axis 66 through the center of the boot.

Therefore, only the cuff flap 46 need be positioned with respect to the outer portion 42 of the cuff 40. This allows a skater to position and hold the cuff flap 46 proximate the outer portion 42 with one hand, while easily inserting the free end of the buckle strap 52 into the locking strap receiver 50 and actuating the buckle lever 48 with the remaining free hand.

The non-extended nature of the outer portion 42 of the cuff 40 therefore allows the cuff flap 46 to easily be tucked under the outer portion 42 to provide an overlap 68 proximate the lateral side of the boot. It should be recognized that if the outer portion 42 included a relatively short cuff flap with respect to the cuff flap 46, the same benefit would arise, i.e., the skater would only have to hold the longer cuff flap 46 to provide the desired orientation of the overlap 68.

Figure 5:
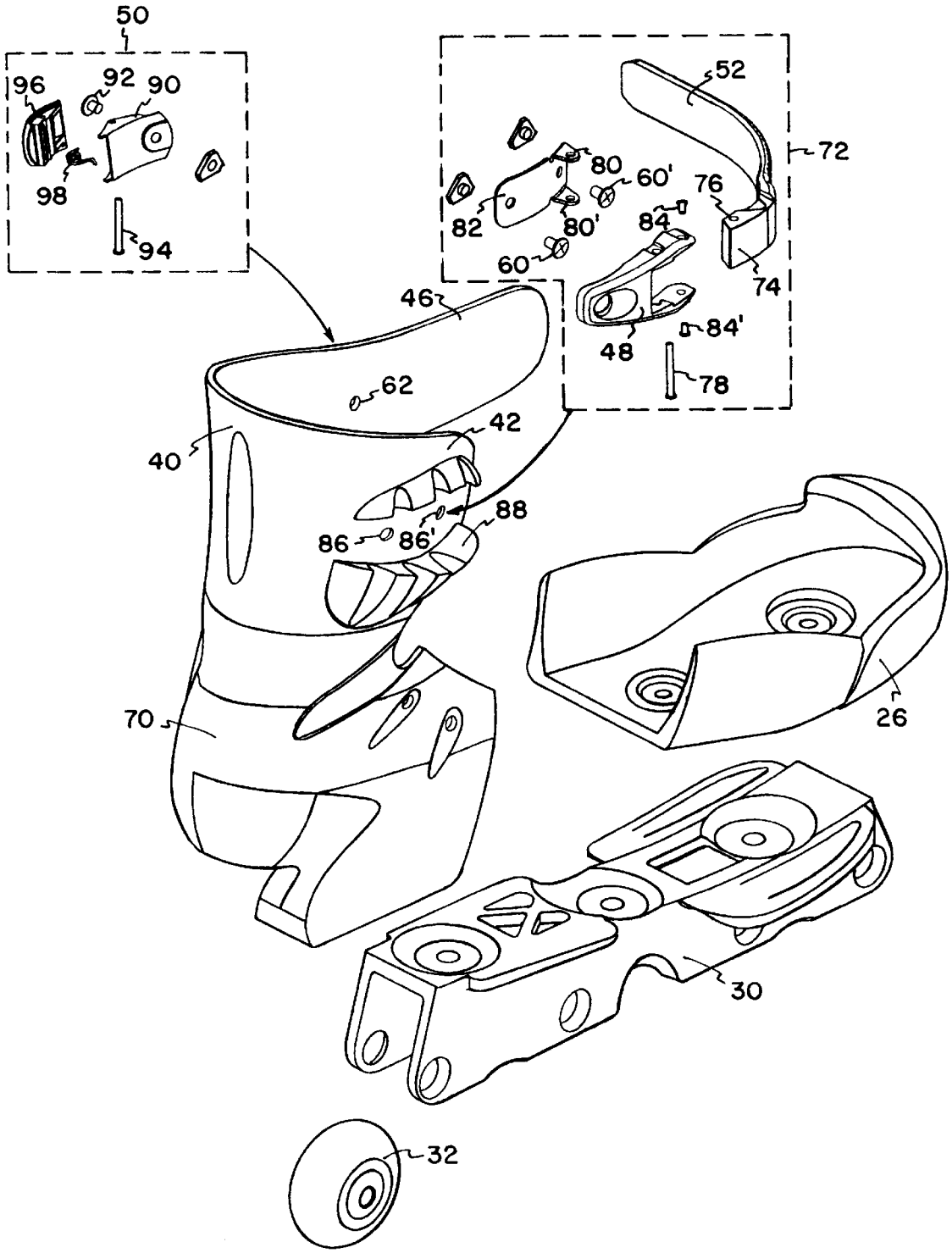
FIG. 5 is an exploded view of one embodiment of a cuff assembly for an in-line skate in accordance with the present invention.

FIG. 5 is an exploded view of one embodiment of a cuff assembly for an in-line skate in accordance with the present invention. The back or heel portion 70 of the boot is integrated with the cuff 40. The heel portion 70 and the toe portion 32, which together provide a complete shell for a skater's foot, are fastened to the frame 30. A plurality of wheels 32 are rotatedly mounted to the frame 30.

FIG. 5 illustrates the comparative length of the cuff flap 46 and the outer portion 42 of the cuff 40. The lengths of these portions are determined by the length required for cuff flap 46 to reach the outer portion 42, while maintaining the overlap of the outer portion 42 over cuff flap 46 proximate the lateral side of the boot.

A buckle lever and strap assembly 72 includes the previously described buckle lever 48 and buckle strap 52. The buckle strap 52 includes a connection end 74 having an axial opening 76 to which pin 78 can be inserted to allow connection end 74 to rotate about the pin 78. The buckle lever 48 is attached to flaps 80 and 80' of mounting plate 82 via pins 84 and 84' respectively, which can be screws, bolts, rivets, or the like. Mounting plate 82 is then fastened to the outer portion 42 of the cuff 40 into openings 86 and 86' using rivets 60 and 60', which can also be screws, bolts, etc. Pressing the buckle lever 48 down towards the cuff 40 therefore acts as a lever to pull the buckle strap 52 towards the back side of the boot. The buckle protector 88 helps protect the buckle from being inadvertently opened during skating.

The locking buckle strap receiver 50 depicted in FIG. 5 includes a receiver mounting plate 90 which is attached to the long cuff flap 46 by way of attachment means such as screw 92. Pin 94 pivotally mounts locking mechanism 96 to the receiver mounting plate 90. A spring 98 allows the locking mechanism 96 to engage a particular one of the teeth or grooves of the buckle strap 52. When the buckle strap 52 is locked into the buckle strap receiver 50, the buckle lever 48 is actuated to pull the cuff flap 46 around the front of the boot towards the outer portion 42 of the cuff 40.

In the embodiment illustrated in FIG. 5, the motion imparted on the buckle strap 52 occurs due to the nature of the toothed buckle strap 52 in relation to the buckle strap receiver 50. The buckle strap 52 includes multiple inclined teeth into which a locking edge or pawl drops so that the buckle strap 52 can be inserted into the buckle strap receiver 50, but cannot be removed without overriding the force of the spring 98. The locking edge or pawl is located on the locking mechanism 96, which is forced into the teeth of the toothed buckle strap 52 by the spring 98.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. An in-line skate, comprising:

a boot having a front portion and a back portion, and having a medial portion and a lateral portion corresponding respectively to a medial side and a lateral side of a skater's leg;

a leg cuff encasing the back, medial and lateral portions of the boot and having an end proximate the lateral portion of the boot, including a cuff flap originating proximate the medial portion of the boot and extending to an end of the cuff flap, the cuff flap having sufficient length to traverse the front portion of the boot and create an overlap with the leg cuff proximate the lateral portion of the boot wherein the overlap is created by tucking the end of the cuff flap under the leg cuff proximate the lateral portion of the boot;

a buckle lever coupled to the leg cuff proximate the lateral portion of the boot;

a buckle strap extending between a mounting end mounted to the suckle lever and a free end;

a buckle strap latching mechanism attached to the cuff flap, to engage the free end of the buckle strap;

wherein a portion of the buckle strap opposes an outer surface of the leg cuff when the free end of the buckle strap is engaged by the buckle strap latching mechanism, the buckle strap portion extending from the mounting end of the buckle strap to an area of the buckle strap aligned with the leg cuff end proximate the lateral portion of the boot; and wherein the leg cuff is tightened around the skater's leg upon actuating the buckle lever, thereby moving the buckle strap latching mechanism and the cuff flap towards the lateral portion of the boot.

2. The in-line skate as in claim 1, wherein the cuff flap is integral to the leg cuff.

3. The in-line skate as in claim 1, wherein the cuff flap is attached to the leg cuff proximate the medial portion of the boot.

4. The in-line skate as in claim 1, further comprising a lateral cuff flap integrally coupled to the leg cuff proximate the lateral portion of the boot, wherein the lateral cuff flap is substantially shorter than the cuff flap.

5. The in-line skate as in claim 1, wherein the buckle strap comprises a toothed strap having a plurality of inclined teeth spanning the buckle strap to the mounting end of the buckle strap.

6. The in-line skate as in claim 5, wherein the buckle strap latching mechanism includes a locking edge to engage a desired one of the inclined teeth of the buckle strap.

7. The in-line skate as in claim 1, wherein the mounting end of the buckle strap is pivotally mounted to the buckle lever to pull the buckle strap upon actuating the buckle lever.

8. A boot shell, for use with a skate having a buckle strap with a mounting end and a free end, comprising:

a leg cuff having a back portion, a medial portion, and a lateral portion configured and arranged to respectively envelop a back leg portion, a medial leg portion, and a lateral leg portion of a leg, the lateral portion extending to an end of the leg cuff and having the mounting end of the buckle strap coupled thereto;

a cuff flap coupled to the medial portion of the leg cuff having a length sufficient to reach the lateral portion of the leg cuff and create an overlap with the lateral portion of the leg cuff proximate the lateral portion of the boot wherein the overlap is created by tucking an end of the cuff flap under the lateral portion of the leg cuff proximate the lateral portion of the boot;

buckle strap latching means attached to the cuff flap for receiving and engaging the free end of the buckle strap which originates proximate the lateral portion of the leg cuff; and wherein a portion of the buckle strap opposes an outer surface of the lateral portion of the leg cuff when the free end of the buckle strap is engaged by the buckle strap latching means, the buckle strap portion extending from the mounting end of the buckle strap to an area of the buckle strap aligned with the leg cuff end.

9. The boot shell as in claim 8, wherein the cuff flap comprises receiving means for facilitating attachment of the buckle strap latching means to the cuff flap.

10. The boot shell as in claim 8, wherein the cuff flap is integral to the leg cuff.

11. The boot shell as in claim 8, wherein the cuff flap is attached to the leg cuff proximate the medial portion of the boot.

12. The boot shell as in claim 8, further comprising a lateral cuff flap integrally coupled to the leg cuff proximate the lateral portion of the boot, wherein the lateral cuff flap is substantially shorter than the cuff flap.

13. A shoe for use with a skate having a molded lower boot, comprising:

a soft leg cuff having a back portion, a medial portion, and a lateral portion, configured and arranged to respectively envelop a back leg portion, a medial leg portion, and a lateral leg portion of a leg, the lateral portion extending to an end of the soft leg cuff, wherein the soft leg cuff is coupled to the molded lower boot and is flexible relative to the molded lower boot;

a cuff flap coupled to the medial portion of the soft leg cuff having a length sufficient to reach the lateral portion of the soft leg cuff and create an overlap with the lateral portion of the soft leg cuff proximate the lateral portion of the boot wherein the overlap is created by tucking an end of the cuff flap under the lateral portion of the soft leg cuff proximate the lateral portion of the boot;

a buckle strap extending between a mounting end coupled proximate the lateral portion of the soft leg cuff and a free end;

buckle strap latching means attached to the cuff flap for receiving and engaging the free end of the buckle strap; and wherein a portion of the buckle strap opposes an outer surface of the lateral portion of the soft leg cuff when tie free end of the buckle strap is engaged by the buckle strap latching means, the buckle strap portion extending from the mounting end of the buckle strap to an area of the buckle strap aligned with the soft leg cuff end.

14. The shoe as in claim 13, wherein the cuff flap is integral to the soft leg cuff.

15. The shoe as in claim 13, wherein the cuff flap is attached to the soft leg cuff proximate the medial portion of the soft leg cuff.

16. The in-line skate as in claim 13, further comprising a lateral cuff flap integrally coupled to the leg cuff proximate the lateral portion of the soft leg cuff, wherein the lateral cuff flap is substantially shorter than the cuff flap.

17. The in-line skate as in claim 1 wherein the buckle strap latching mechanism is sufficiently spaced from the end of the cuff flap to prevent the leg cuff from overlapping the buckle strap latching mechanism when the buckle lever is actuated.

18. The in-line skate as in claim 8 wherein the buckle strap latching mechanism is sufficiently spaced from the end of the cuff flap to prevent the soft leg cuff from overlapping the buckle strap latching mechanism when the buckle lever is actuated.

19. The in-line skate as in claim 13 wherein the buckle strap latching mechanism is sufficiently spaced from the end of the cuff flap to prevent the leg cuff from overlapping the buckle strap latching mechanism when the buckle lever is actuated.

* * * * *